US008454091B2

(12) United States Patent
Therrien et al.

(10) Patent No.: US 8,454,091 B2
(45) Date of Patent: Jun. 4, 2013

(54) CHAIR ADJUSTMENT MECHANISM

(75) Inventors: Yves Therrien, Cowansville (CA); Céline Langelier, Granby (CA)

(73) Assignee: Groupe Dutailier Inc., Saint-Pie (Quebec) (CA)

( * ) Notice: Subject to any disclaimer, the term of this patent is extended or adjusted under 35 U.S.C. 154(b) by 240 days.

(21) Appl. No.: 12/797,310

(22) Filed: Jun. 9, 2010

(65) Prior Publication Data

US 2011/0304182 A1 Dec. 15, 2011

(51) Int. Cl.
*A47C 1/032* (2006.01)

(52) U.S. Cl.
USPC ..... 297/313; 297/328; 297/374

(58) Field of Classification Search
USPC ..... 297/313, 344.1, 363–365, 374
See application file for complete search history.

(56) References Cited

U.S. PATENT DOCUMENTS

| | | | | |
|---|---|---|---|---|
| 3,966,253 | A | 6/1976 | Berghof et al. | |
| 4,408,799 | A * | 10/1983 | Bowman | 297/354.12 |
| 4,636,004 | A * | 1/1987 | Neumuller | 297/374 |
| 5,066,069 | A | 11/1991 | DeGelder | |
| 5,356,200 | A * | 10/1994 | Stumpf et al. | 297/328 |
| 5,361,646 | A * | 11/1994 | Venable | 74/531 |
| 5,560,682 | A * | 10/1996 | Brown | 297/374 |
| 5,584,533 | A | 12/1996 | Schrewe | |
| 5,676,425 | A * | 10/1997 | Pernicka | 297/374 |
| 5,718,481 | A | 2/1998 | Robinson | |
| 6,131,998 | A * | 10/2000 | Su | 297/374 |
| 6,267,444 | B1 * | 7/2001 | Schumann | 297/374 |
| 6,394,550 | B1 * | 5/2002 | Liu | 297/374 |
| 6,467,842 | B1 * | 10/2002 | Lu | 297/316 |
| 6,467,845 | B1 * | 10/2002 | Chen | 297/374 |
| 6,832,815 | B2 | 12/2004 | O'Connor | |
| 6,983,994 | B2 | 1/2006 | Pino | |
| 7,144,080 | B2 | 12/2006 | Lloyd | |
| 7,296,857 | B2 * | 11/2007 | Shinozaki et al. | 297/365 |
| 2009/0243359 | A1 | 10/2009 | Yoshida et al. | |

FOREIGN PATENT DOCUMENTS

| | | |
|---|---|---|
| EP | 2 127 937 A1 | 12/2009 |
| WO | WO 90/00871 | 2/1990 |

* cited by examiner

*Primary Examiner* — Peter Brown
(74) *Attorney, Agent, or Firm* — McDermott, Will & Emery LLP

(57) ABSTRACT

A chair adjustment mechanism for adjusting a position of a chair component. The mechanism comprises a first adjustment shaft, a second support shaft, as well as a set of friction plates, each friction plate comprising an elongated slot and the friction plates being fixedly mounted on the second support shaft while being slideably mounted on the first adjustment shaft. A guiding structure directs movement of the second support shaft along a direction of travel of the chair component. An adjustment handle is provided to reversibly compress the friction plates together in a locked position for fixing position of the component of the chair through braking displacement of the second support shaft along the guiding structure. The plurality of friction plates provides greater braking pressure for locking the mechanism.

11 Claims, 6 Drawing Sheets

CHAIR ADJUSTMENT MECHANISM

FIELD OF THE INVENTION

The present invention generally relates to chairs. More particularly, it relates to a chair adjustment mechanism for adjustment of a position of a chair component.

BACKGROUND OF THE INVENTION

Several types of chairs are provided with reclining mechanisms. Certain reclining mechanisms in chairs include a base structure that allows the seat to slide forwards and backwards and cause inclination of the back part of the seat. Current locking mechanisms that are used to stop movement of the base structure and keep the seat base from sliding typically include nut and bolt type interfaces. However, this type of interface does not provide adequate locking capability for positioning of the seat. Bolt systems are typically not very performant and sometimes are subjected to problems after long periods of use.

Several different prior art chair adjustment mechanisms are known to the Applicant.

U.S. Pat. No. 5,066,069 (DeGelder) disclosed a chair having a seat and back adjustment mechanism in which a single handle is operated to hold or release both the seat and the back at selected independent angles. A series of plates on the seat and back are interleaved and positioned to be compressed by the handle.

WO 90/00871 (Lie et al.) teaches another locking device for chair seats. The device comprises several lamellae connected to the seat. Clamping shoes abutting against the outer lamellae may be clamped by bolts for locking the position of the seat in a certain configuration. The lamellae are aligned axially.

Other systems known to the Applicant include U.S. Pat. No. 3,966,253 (Berghof et al.); U.S. Pat. No. 5,584,533 (Schrewe); U.S. Pat. No. 5,718,481 (Robinson); U.S. Pat. No. 6,832,815 (O'Connor); U.S. Pat. No. 6,983,994 (Pino); U.S. Pat. No. 7,144,080 (Lloyd); US 2009/0243359 (Yoshida et al.); and EP 2 127 937 (Omori et al.).

Consequently, there is presently a need for a chair adjustment mechanism that offers improved performance and operates reliably over a longer period of time.

SUMMARY OF THE INVENTION

An object of the present invention is to provide a chair adjustment mechanism that addresses at least one of the above-mentioned needs.

According to the present invention, there is provided a chair adjustment mechanism for adjusting a position of a chair component, the mechanism comprising:

- a first adjustment shaft;
- a second support shaft;
- a set of friction plates, the friction plates being fixedly mounted on the second support shaft, and slideably mounted on the first adjustment shaft;
- a guiding structure for guiding movement of the second support shaft along a direction of travel of the chair component;
- an adjustment handle mounted on the first adjustment shaft, the handle being rotatable to reversibly compress the friction plates together in a locked position, wherein the chair component is mounted on the second support shaft and the position of the component is controlled through corresponding movement of the second support shaft along the guiding structure.

The use of the plurality of friction plates provides a greater braking pressure for locking the mechanism through the adjustment shaft.

BRIEF DESCRIPTION OF THE DRAWINGS

These and other objects and advantages of the invention will become apparent upon reading the detailed description and upon referring to the drawings in which.

DETAILED DESCRIPTION OF PREFERRED EMBODIMENTS OF THE INVENTION

In the following description, the same numerical references refer to similar elements. The embodiments shown in the figures are preferred.

Moreover, although the present invention was primarily designed for use with adjustment of a seat bottom of a chair, it may be used with other types of chair components, as apparent to a person skilled in the art. For this reason, expressions such as "chair" or "seat" used herein should not be taken as to limit the scope of the present invention and include all other kinds of chair assemblies or items with which the present invention could be used and may be useful.

Moreover, in the context of the present invention, expressions such as "structure" and any other equivalent expression and/or compound words thereof known in the art will be used interchangeably.

In addition, although the preferred embodiments of the present invention are illustrated in the accompanying drawings and although the preferred embodiments of the adjustment mechanism as shown consist of certain geometrical configurations as explained and illustrated herein, not all these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the adjustment mechanism and corresponding parts according to the present invention, as briefly explained and inferred herein, without departing from the scope of the invention.

Referring to any one of FIG. 1*a* to 6*b*, a chair adjustment mechanism 10 is shown.

Figure 1B:
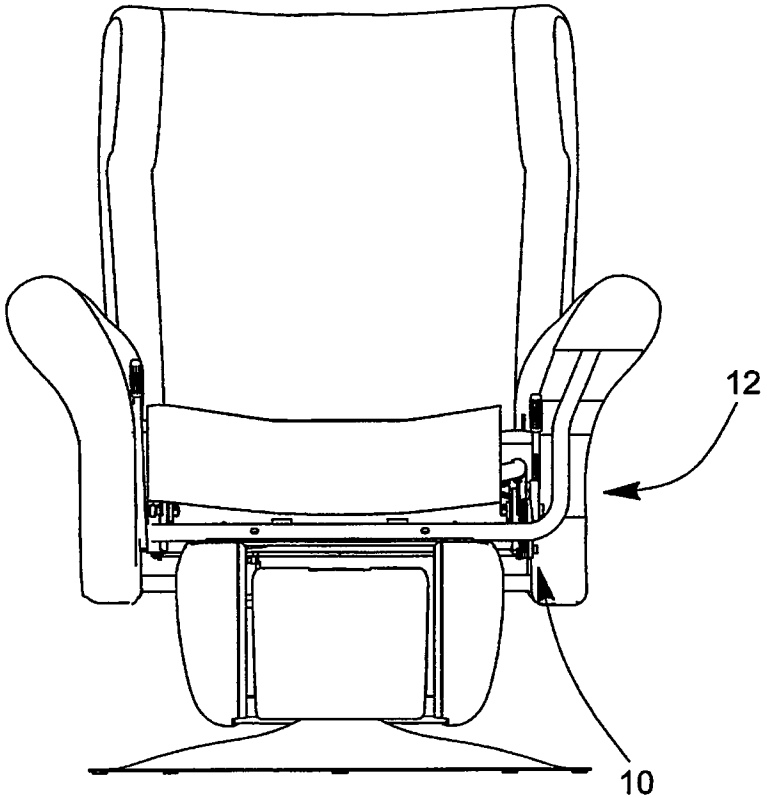
FIG. 1*a* and 1*b* are side and front views respectively of an adjustment mechanism according to a preferred embodiment of the present invention.
Figure 1A:
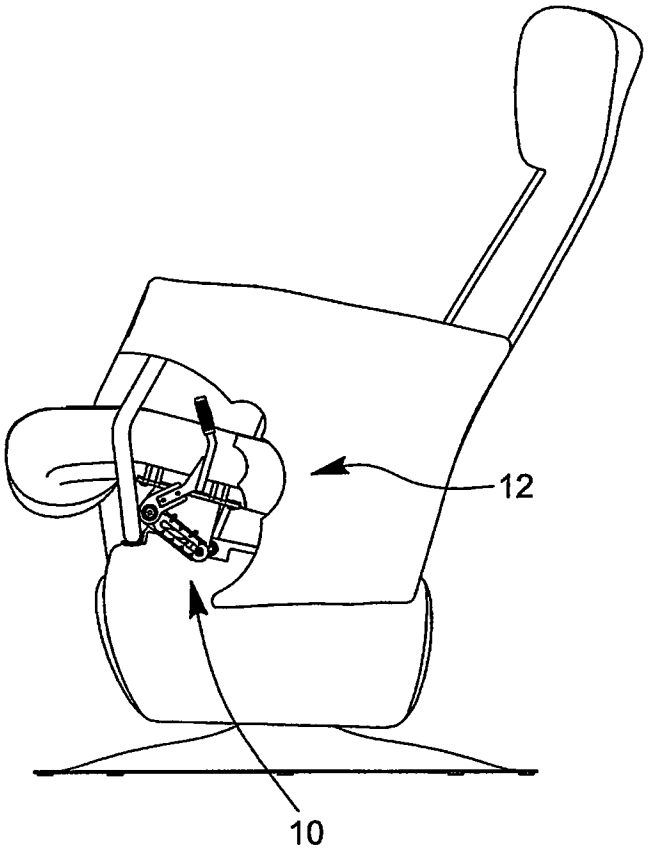
Figure 2:
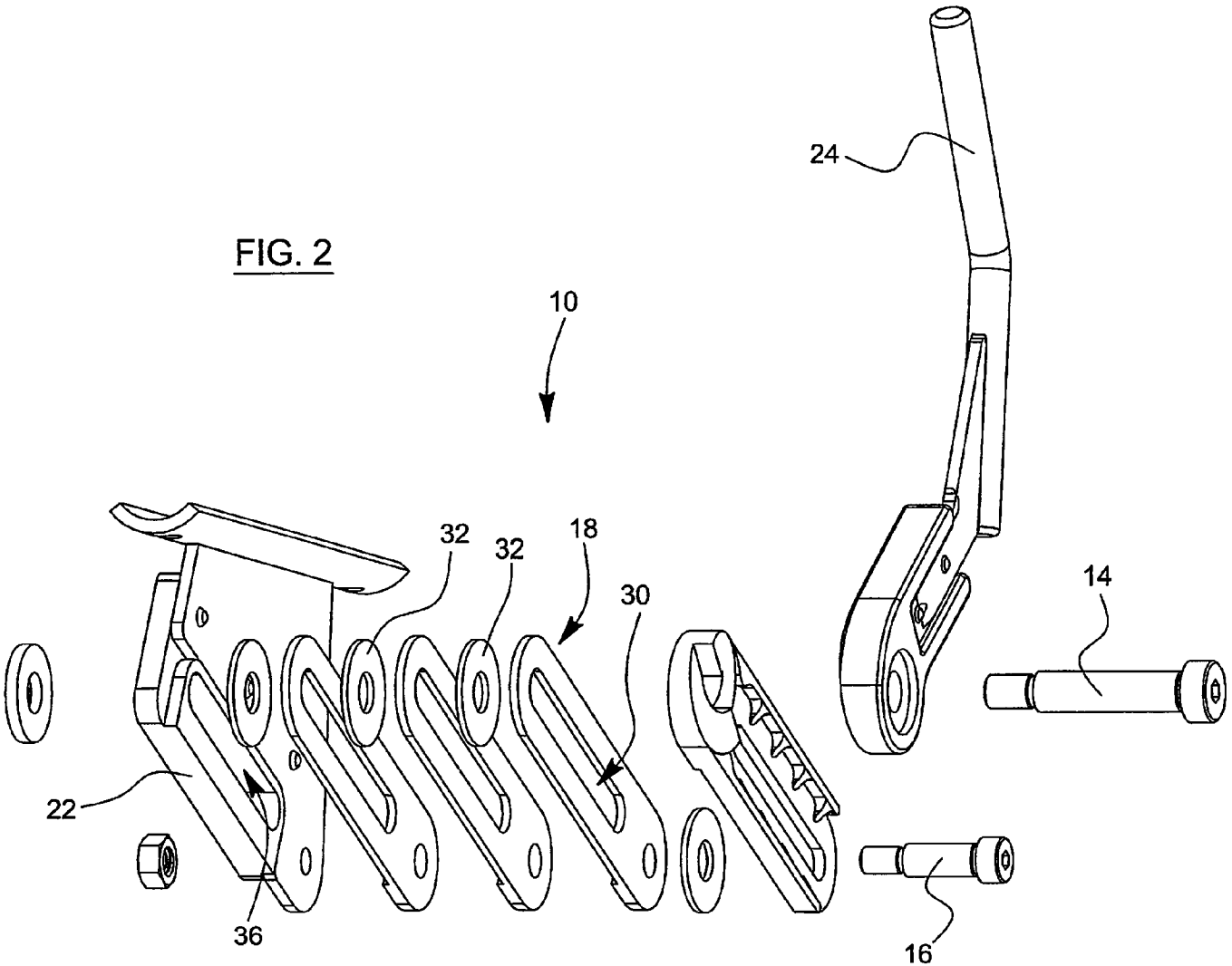
FIG. 2 is an exploded view of the locking mechanism shown in FIGS. 1*a* and 1*b;*
Figure 3:
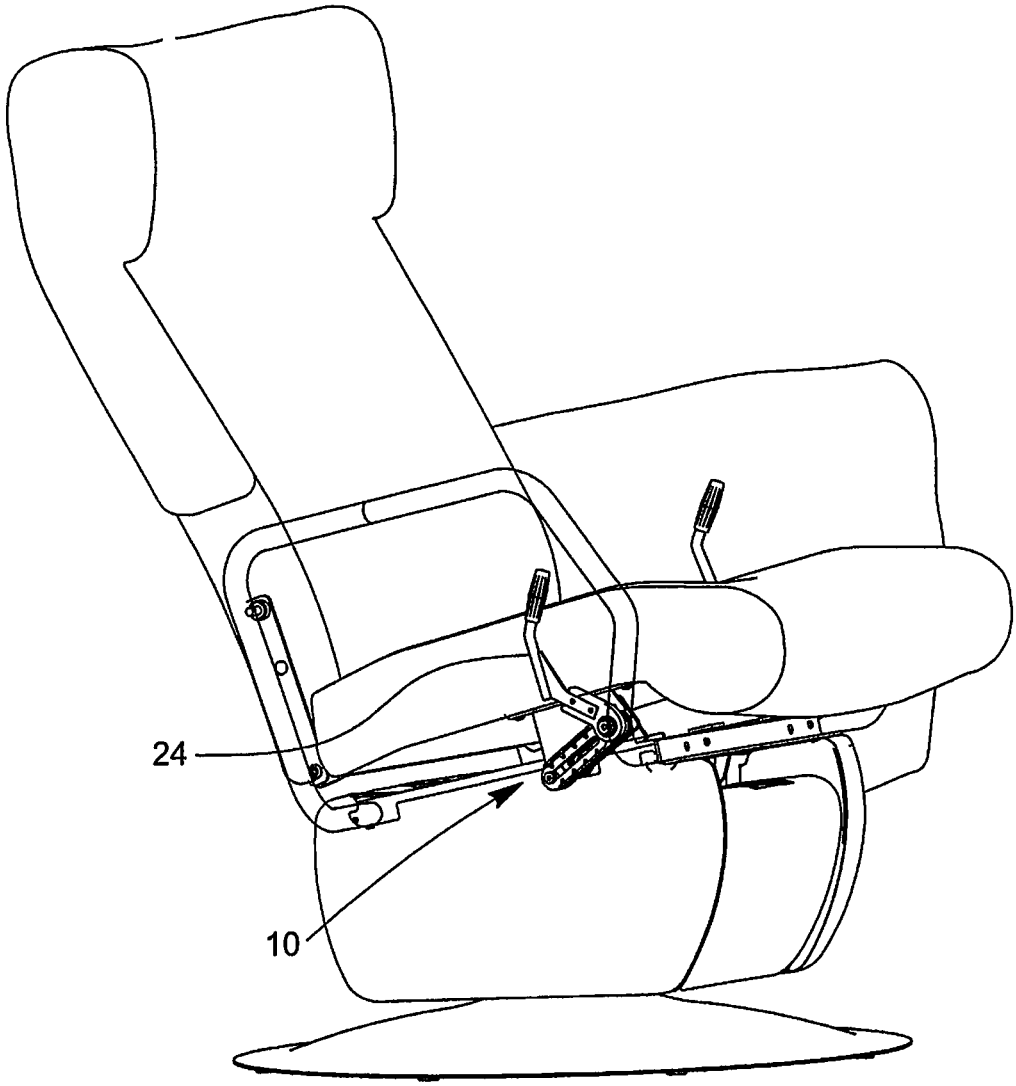
FIG. 3 is a perspective view of a rocking chair with another adjustment mechanism according to another preferred embodiment of the present invention.

As shown in FIG. 1*a* to 1*b*, the chair adjustment mechanism 10 adjusts a position of a chair component 12. As better shown in FIGS. 2 to 6*b*, the mechanism 10 comprises a first adjustment shaft 14, a second support shaft 16 and a set of friction plates 18. The friction plates 18 are fixedly mounted on the second support shaft 16, and slideably mounted on the first adjustment shaft 14. A guiding structure 22 is also provided for guiding movement of the second support shaft 16 along a direction of travel of the chair component 12. An adjustment handle 24 is mounted on the first adjustment shaft 14. The handle 24 is rotatable to reversibly compress the friction plates 18 together in a locked position. The chair component 12 is mounted on the second support shaft 16 and the position of the component 12 is controlled through corresponding movement of the second support shaft 16 along the guiding structure 22.

Preferably, each friction plate 18 comprises an elongated slot 30 to allow relative displacement of the second support shaft 16 and hence displacement of the chair component 12.

Preferably, as better shown in FIGS. 4 to 6*b*, each elongated slot 30 has a slot length substantially parallel to the direction of travel of the chair component 12.

Figure 6:
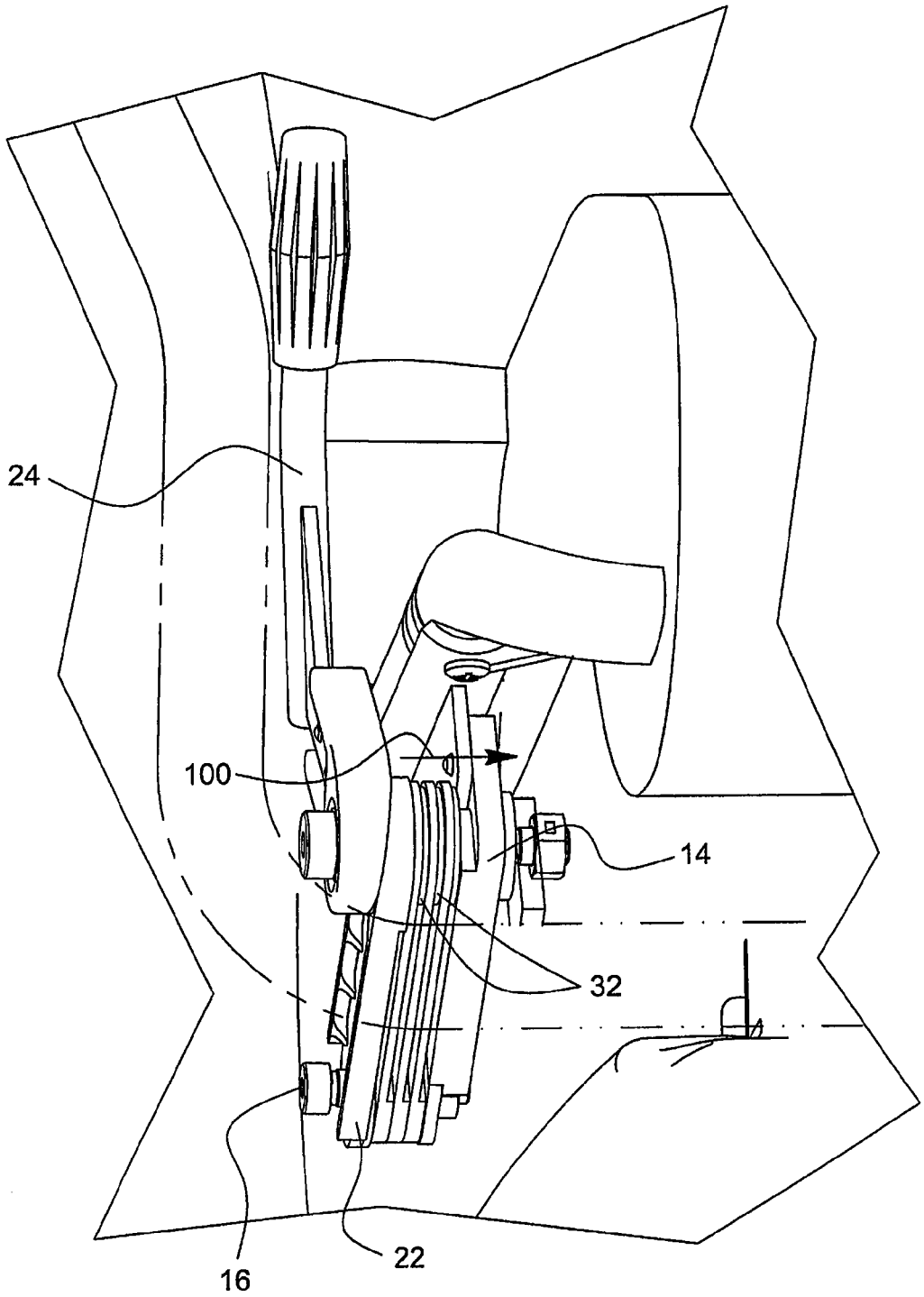
FIG. 6 is a perspective detailed view of the adjustment mechanism shown in FIG. 5, illustrating the action of the set of friction plates.

Preferably, as better shown in FIG. 6, washers 32 are positioned between adjacent friction plates 18, the washers 32 being coaxially mounted onto the first adjustment shaft 14.

Figure 4:
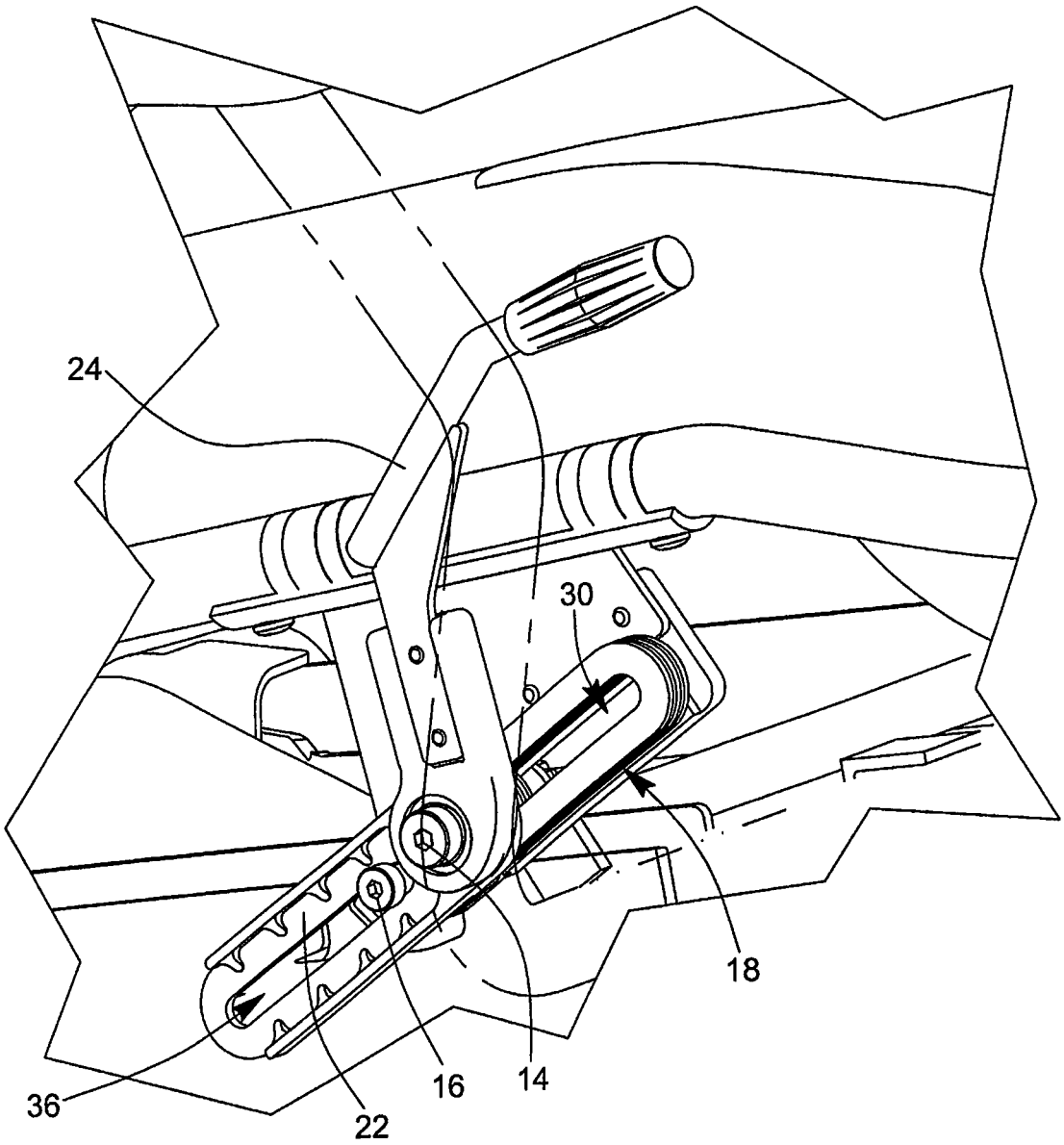
FIG. 4 is a detailed perspective view of the adjustment mechanism shown in FIG. 3 with the mechanism in a locked position.
Figure 5:
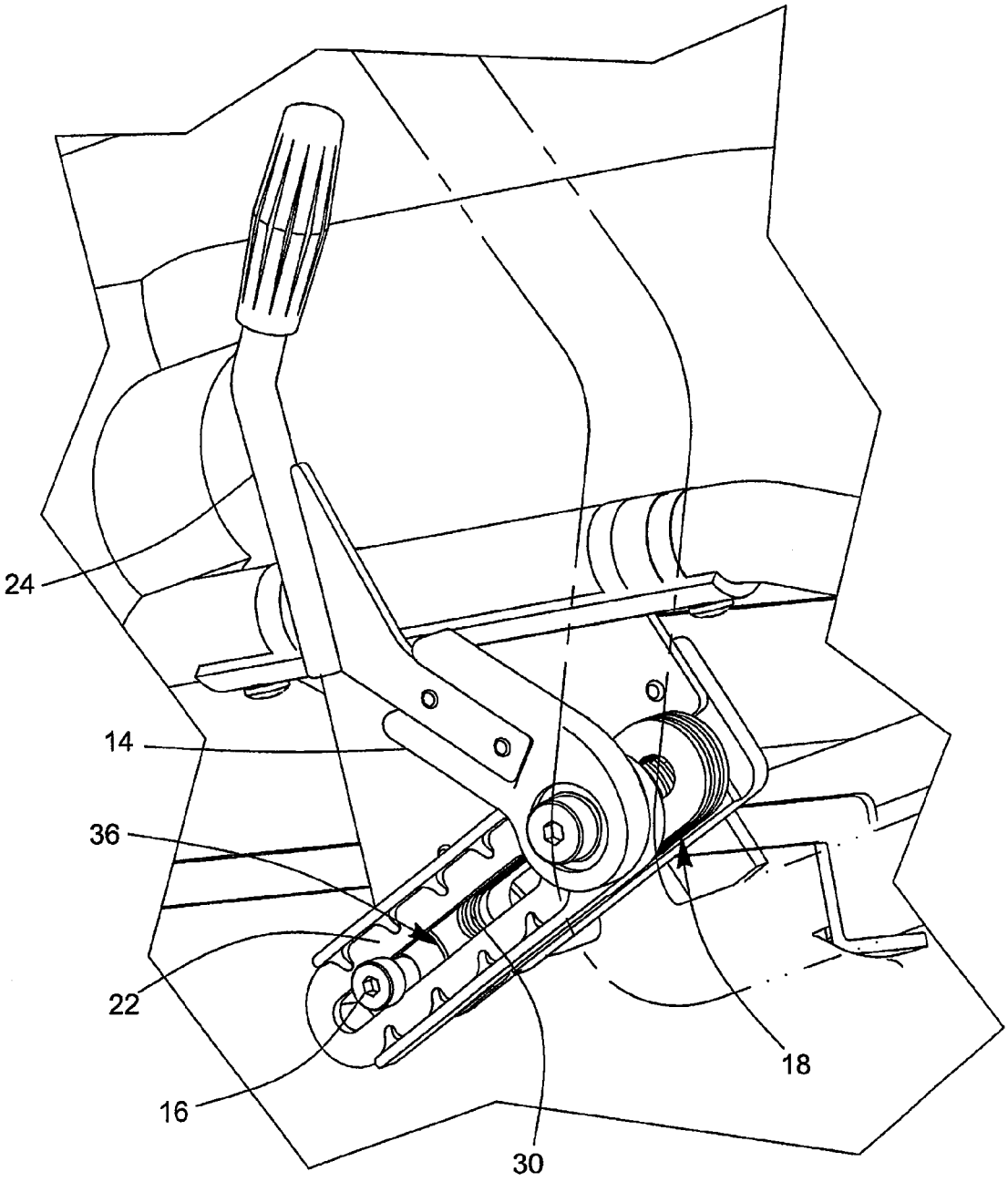
FIG. 5 is a detailed perspective view of the adjustment mechanism of FIG. 4 with the mechanism in an unlocked position for adjustment of the reclining of the chair.

Preferably, as better shown in FIGS. 4 and 5, the guiding structure 22 has an elongated slot 36 substantially similar in shape to the elongated slots 30 of the friction plates 18. The slot 36 is sized to slideably receive the second support shaft 16 for displacement of the support shaft 16 therealong.

Preferably, as shown in FIG. 6, the first adjustment shaft 14 is displaced by the adjustment handle 24 in a helicoidal manner.

Preferably, the chair component is a chair seat bottom. However, the adjustment mechanism according to the present invention may be used for adjustment of other chair components.

The adjustment mechanism according to the present invention is actuated by a handle to be manoeuvered between a locked position shown in FIG. 4 for example and an unlocked position shown in FIG. 5. As better shown in FIG. 6, the handle is used to apply through a screwing action a pressure along a transversal direction 100 with respect to the longitudinal displacement of the friction plates to lock the plates in a particular position. As mentioned above, the use of the plurality of blades provides a greater braking pressure for locking the mechanism through the helicoidal movement of the adjustment shaft 14 as shown in FIG. 6.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. A chair adjustment mechanism for adjusting a position of a chair component with respect to a chair base structure, said mechanism comprising:

a first adjustment shaft;

a second support shaft;

a set of friction plates, said friction plates being fixedly mounted on the second support shaft, and slideably mounted on the first adjustment shaft, each friction plate comprising an elongated slot;

a guiding structure mounted on the chair base structure for guiding movement of the second support shaft along a direction of travel of the chair component, the guiding structure having a guiding structure elongated slot substantially similar in shape to the elongated slots of the friction plates, and sized to slideably receive the second support shaft for displacement of the support shaft therealong;

an adjustment handle mounted on the first adjustment shaft, the handle being rotatable to reversibly compress the friction plates together in a locked position, wherein the chair component is mounted on the second support shaft and the position of the component is controlled through corresponding movement of the second support shaft along the guiding structure.

2. The chair adjustment mechanism according to claim 1, wherein each elongated slot has a slot length substantially parallel to the direction of travel of the chair component.

3. The chair adjustment mechanism according to claim 2, wherein the first adjustment shaft is displaced by the adjustment handle in a helicoidal manner.

4. The chair adjustment mechanism according to claim 2, wherein the chair component is a chair seat bottom.

5. The chair adjustment mechanism according to claim 1, further comprising washers positioned between adjacent friction plates, said washers being coaxially mounted onto the first adjustment shaft.

6. The chair adjustment mechanism according to claim 5, wherein the first adjustment shaft is displaced by the adjustment handle in a helicoidal manner.

7. The chair adjustment mechanism according to claim 5, wherein the chair component is a chair seat bottom.

8. The chair adjustment mechanism according to claim 1, wherein the first adjustment shaft is displaced by the adjustment handle in a helicoidal manner.

9. The chair adjustment mechanism according to claim 8, further comprising washers positioned between adjacent friction plates, said washers being coaxially mounted onto the first adjustment shaft.

10. The chair adjustment mechanism according to claim 9, wherein each elongated slot has a slot length substantially parallel to the direction of travel of the chair component.

11. The chair adjustment mechanism according to claim 1, wherein the chair component is a chair seat bottom.

* * * * *